US005509647A

United States Patent [19]

Iwanaga

[11] Patent Number: 5,509,647

[45] Date of Patent: Apr. 23, 1996

[54] SHEET GUIDING DEVICE HAVING OBLIQUELY-MOVABLE SHEET RESTRICTION PORTION

[75] Inventor: Yoshiharu Iwanaga, Tokyo, Japan

[73] Assignee: Canon Kabushiki Kaisha, Tokyo, Japan

[21] Appl. No.: 245,078

[22] Filed: May 17, 1994

Related U.S. Application Data

[63] Continuation of Ser. No. 888,176, May 26, 1992, abandoned.

[30] Foreign Application Priority Data

Jun. 3, 1991 [JP] Japan ..... 3-131196

[51] Int. Cl.[6] ..... B65H 9/00

[52] U.S. Cl. ..... 271/238

[58] Field of Search ..... 271/238, 240, 271/253–255, 171, 144

[56] References Cited

U.S. PATENT DOCUMENTS

| | | | |
|---|---|---|---|
| 2,265,234 | 12/1941 | Jensen | 271/255 |
| 2,528,106 | 10/1950 | Albrecht | 271/240 |
| 3,061,303 | 10/1962 | Glaser | 271/240 X |
| 3,140,090 | 7/1964 | Winkler | 271/171 |
| 4,697,803 | 10/1987 | Kan et al. | 271/171 X |
| 4,907,792 | 3/1990 | Washiashi | 271/253 X |
| 5,090,673 | 2/1992 | Kitahara | 271/254 X |

FOREIGN PATENT DOCUMENTS

| | | | |
|---|---|---|---|
| 212331 | 12/1984 | Japan | 271/171 |
| 7157 | 1/1986 | Japan | 271/253 |
| 51424 | 3/1986 | Japan | 271/171 |
| 185730 | 8/1988 | Japan | 271/253 |
| 242326 | 9/1989 | Japan | 271/171 |
| 8631 | 1/1991 | Japan | 271/171 |
| 112152 | 4/1992 | Japan | 271/171 |
| 260541 | 9/1992 | Japan | 271/171 |
| 1419507 | 12/1975 | United Kingdom | 271/171 |

*Primary Examiner*—William E. Terrell
*Assistant Examiner*—Tamara Kelly
*Attorney, Agent, or Firm*—Fitzpatrick, Cella, Harper & Scinto

[57] ABSTRACT

A sheet guiding device guides sheets which are to be fed out to a device for processing the sheets. The sheet guiding device includes a sheet loading unit on which the sheets are loaded, a pair of restriction members for contacting a side edge of the sheets loaded on the sheet loading unit to restrict a position of the sheets, and a support unit for supporting the restriction members such that the restriction members are movable obliquely relative to a direction in which the sheets are fed.

19 Claims, 18 Drawing Sheets

SHEET GUIDING DEVICE HAVING OBLIQUELY-MOVABLE SHEET RESTRICTION PORTION

This application is a continuation of application Ser. No. 07/888,176, filed May 26, 1992, now abandoned.

BACKGROUND OF THE INVENTION

1. Field of the Invention

The present invention relates to a sheet guiding device for use in a facsimile or copying machine, for example, as a sheet guiding device of an original document feeding device for a facsimile or copying machine. More particularly, it relates to a sheet guiding device which guides sheets in a state where the conveyance reference thereof is located at the center of the sheet guiding device.

2. Description of the Related Art

FIGS. 17 to 19 illustrate a conventional sheet guiding device which is utilized as part of an original document feeding device for a facsimile machine.

In FIG. 17, reference character 1 denotes an original platen formed on the upper surface of a facsimile machine body. Original documents are placed on this original platen 1. Reference numerals 52 and 53 denote sheet guides which are position restricting members disposed in contact with or adjacent to side edge portions of an original document P (see FIG. 18) (hereinafter also referred to as a "sheet") placed on the original platen 1 to restrict the position of the sheet side edge portions. The sheet guides 52 and 53 are movable in a direction perpendicular to the sheet feeding direction, indicated by arrow A in FIG. 18, so that they can restrict the position of the side edge portions of sheets having various sizes, such as A row and B row, as shown in FIG. 18.

When one of the side guides 52 and 53 is moved, that movement is linked to movement of the other one, whereby the other one is also moved, so that the center of the sheet to be guided is located at a fixed position.

The structure of the sheet guides 52 and 53 will be described below with reference to FIGS. 20 and 21.

As shown in FIGS. 20 and 21, a portion of each of the sheet guides 52 and 53 is fitted into a groove 54 formed in the original platen 1 as a guide member. Rack members 57 and 58 are mounted on those portions of the sheet guides 52 and 53 by means of screws 59. Rack members 57 and 58 are arranged in mesh with a pinion 56 provided at the central portion of the original platen 1. When sheet guide 53 is moved in a direction indicated by an arrow 'a', pinion 56 is rotated in a direction indicated by an arrow 'c', whereby sheet guide 52 is moved in an outward direction indicated by an arrow 'b'. When sheet guide 53 is moved in a direction opposite to the direction indicated by the arrow 'a', sheet guide 52 is moved in an inward direction reverse to the direction indicated by the arrow 'b'. The width between the sheet guides 52 and 53 is thus adjusted by opening or closing the sheet guides according to the width of the original document. The sheet guides 52 and 53 may be fixed to a preselected position by means of a click (temporary fixing means).

However, in the aforementioned conventional sheet guiding device, since the sheet guides move in a direction perpendicular to the sheet feeding direction, by a distance corresponding to the width of the various types of sheets, and then guide the forward portion of the sheets with respect to the sheet feeding direction, indicated by the arrow A in FIG. 18, when large sheets having, for example, an A3 size, are fed, they may be fed slantingly because only the forward portions thereof are guided. When the guiding position is set for sheets having a large size (A3), sheets having a small size (A5) may be fed slantingly or may not be set correctly because only the trailing edge portions thereof are guided. Furthermore, since the sheet guides move in a direction perpendicular to the sheet feeding direction, if the click is weak, sheet guides 52 and 53 may be moved away from each other by the sheets. Consequently, correct guiding of the sheets may be prevented, and the sheets may be fed obliquely.

A sheet feeding device having sheet guides 52 and 53, as shown in FIG. 19, is also known. The sheet guides 52 and 53 have proximal end portions **52*a* and 53*a* formed parallel to the original platen 1. Pins 52*c* and 53*c*, projecting from the proximal end portions 52*a* and 53*a* in a downward direction, are fitted into grooves 52*b* and 53*b* formed in the original platen 1 in such a manner as to be slidable therealong, whereby sheet guides 52 and 53 are made movable in a direction perpendicular to the sheet feeding direction. In this structure, the space W1 between the pins 52*c* and between the pins 53*c* cannot be increased. Thus, sheet guides 52 and 53 have a backlash in a sub-direction thereof, as shown by arrows 'd' in FIG. 19**, and may thus make the sheets feed obliquely.

There is not a great difference in width between the sheet sizes A4 and LTR, and those sizes may be indistinguishable from each other by a size detecting device of the type which employs, for example, a microswitch. The size displayed on the original platen by means of a silk-screen process may not be visible at all or may not be clearly visible.

Furthermore, when large sheets are to be fed, an auxiliary member 51 provided at the rear end of the original platen 1 is rotated about a shaft **51*a*, as shown in FIG. 17, to receive the trailing edge portion of the large sheets (B4, A3). The trailing edge support plate has support portions 51*a* at the right and left thereof. A pin provided on each of the support portions 51*a* is in engagement with a hole opened in the original platen. The trailing edge support plate is mounted on the original platen by inserting the pins into the right and left holes utilizing the elasticity of the material which forms the trailing edge support plate. Therefore, the trailing edge support plate, which remains open in a state indicated by a dot-dashed line in FIG. 17**, may become an obstacle. When a user bumps the opened trailing edge support plate, the plate may come off or the pins provided at the two ends thereof may break. Also, a large number of originals placed on the trailing edge support plate may bend the trailing edge support plate. Finally, it is difficult to open the trailing edge support plate after the originals are placed thereon.

SUMMARY OF THE INVENTION

An object of the present invention is to provide a sheet guiding device which is capable of preventing an unwanted shift in the position of a restricting member arranged for restricting the position of the side edges of loaded sheets.

To achieve the above-described object, the present invention provides a sheet guiding device, including sheet loading means on which a sheet is loaded, restriction means for contacting a side edge of a sheet loaded on the sheet loading means, thereby restricting a position of the sheet, and support means for supporting the restriction means such that the restriction means is movable obliquely relative to a direction in which the sheet is to be fed.

In another aspect, the present invention relates to a sheet feeding device for feeding a sheet to means for processing the sheet. The device includes a sheet loading means on which a sheet is loaded, restriction means for contacting a side edge of a sheet that is loaded on the sheet loading means, thereby restricting a position of the sheet, support means for supporting the restriction means such that the restriction means is movable obliquely relative to a direction in which the sheet is fed, and feeding means for feeding a sheet restricted by the restriction means to the processing means.

In another aspect, the present invention relates to a sheet processing device including a sheet loading means on which a sheet is loaded, restriction means for contacting a side edge of a sheet that is loaded on the sheet loading means, thereby restricting a position of the sheet, support means for supporting the restriction means such that the restriction means is movable obliquely relative to a direction in which the sheet is fed, feeding means for feeding a sheet restricted by the restriction means, and sheet processing means for processing a sheet fed by the feeding means.

In another aspect, the present invention relates to a sheet guiding device including sheet loading means on which a sheet is loaded, restriction means for contacting a side edge of a sheet loaded on the sheet loading means, thereby restricting a position of the sheet, and support means for supporting the restriction means such that the restriction means is movable obliquely relative to the side edges of a sheet loaded on the sheet loading means.

In another aspect, the present invention relates to a sheet alignment device, including platen or tray means for holding a sheet to be aligned, restriction means for contacting a side edge of a sheet held on the platen or tray means, and support means for supporting the restriction means such that the restriction means is movable obliquely relative to the side edges of a sheet held on the platen or tray means.

The sheet guide means is used to restrict the position of a sheet in the lateral direction thereof when the sheet is supplied to a reading device for reading images formed on the sheet or to an image forming device for forming an image on the sheet or when sheets on which images are formed by the image forming device are discharged.

The restriction means, which is brought into contact with side edge of the sheets, may be provided as a pair of opposing restriction members, so that the two side edges of the sheet can be brought into contact with the restriction means. Linking means for linking the movement of one of the restriction members to movement of the other may be provided. The pair of restriction members may be moved such that they make contact substantially at the center of the side edges of the sheet regardless of the size of the sheet.

As mentioned above, when the sheet restriction means is movable obliquely relative to the side edges of the sheet, it is not readily shifted in an outward direction when compared with convention restriction means, which is designed to move in a direction perpendicular to the side edges of the sheet. Furthermore, since the restriction means supporting portion can be made wider, backlash of the restriction means can be reduced, and oblique feeding of the sheets can thus be reliably prevented.

Furthermore, when the restriction means is designed to restrict a sheet at the center of the side edges thereof, the position of sheets having any size can be reliably restricted, and oblique feeding of the sheets can be prevented.

DETAILED DESCRIPTION OF THE PREFERRED EMBODIMENT

Figure 1:
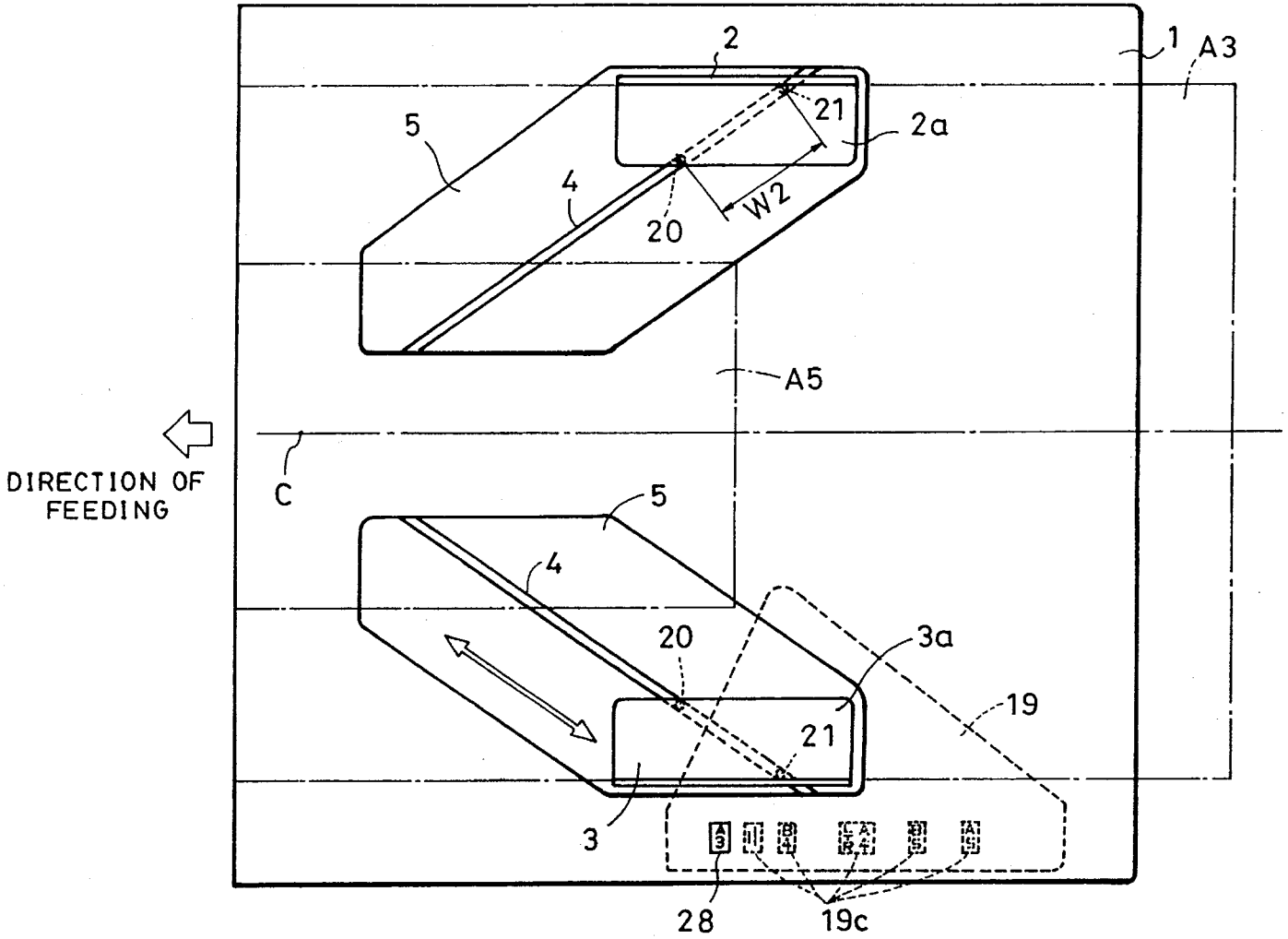
FIG. 1 is a plan view illustrating an embodiment of the present invention.
Figure 2:
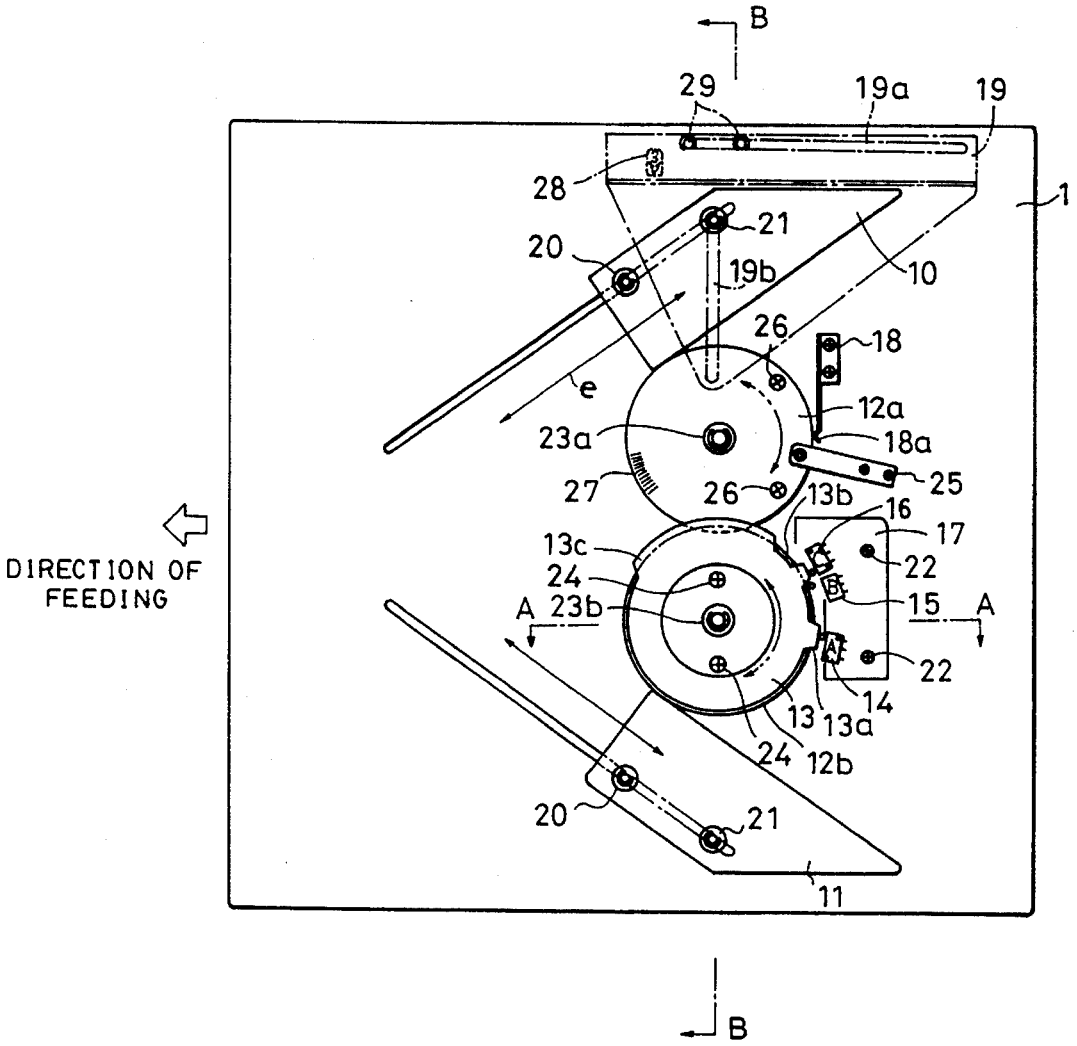
FIG. 2 is a rear view of FIG. 1, illustrating rack members or sliders, pinions, size detection switches and a size display plate.

An embodiment of the present invention will now be described with reference to FIGS. 1 and 2. FIG. 1 is a plan view illustrating an embodiment of the present invention. FIG. 2 is a rear view of the sheet guiding device of FIG. 1. Reference character 1 denotes an original platen 1 on which sheets are placed; 2 and 3 denote sheet guides (right and left) which are position restricting members for guiding the sheets; 4 denotes grooves along which the sheet guides are guided; and 5 denotes recessed surfaces along which the sheet guides 2 and 3 are moved.

Figure 4:
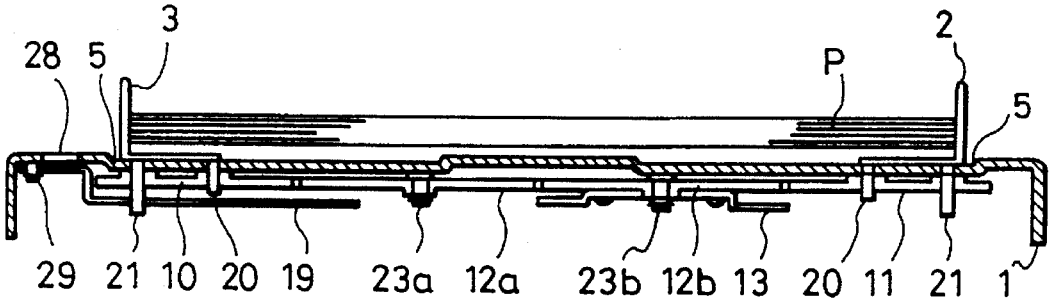
FIG. 4 is a sectional view taken along line B—B of FIG. 2.
Figure 5:
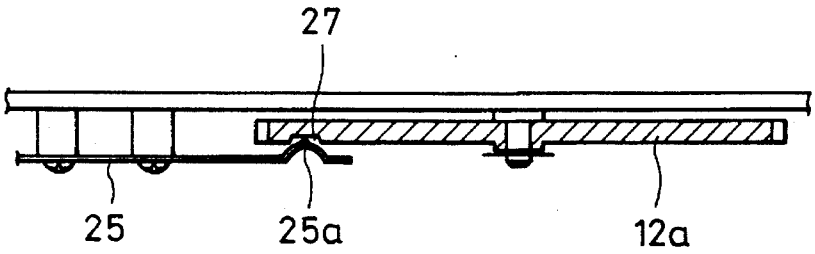
FIG. 5 is a cross-sectional view of a click portion of a small step, shown in FIG. 2.

Shafts 20 and 21, fixed to proximal portions 2*a* and 3*a* of sheet guides 2 and 3, are fitted into the grooves 4. At the rear side of the original platen 1, racks 10 and 11 are fixed to shafts 20 and 21 (FIG. 4). Pinions (gears) 12*a* and 12*b* are rotatably supported on pins 23*a* and 23*b*, respectively, which are provided at the rear surface of the original platen 1. Rack 10 is arranged in mesh with pinion 12*a*, which is in turn in mesh with pinion 12*b*, which is in turn in mesh with rack 11. When either one of sheet guides 2 and 3 is moved along the groove 4, the movement thereof is transmitted to the other sheet guide through racks 10 and 11, and pinions 12*a* and 12*b*, whereby the sheet guides 2 and 3 are maintained at positions which are symmetrical with respect to the center line C of the original platen 1.

Figure 3:
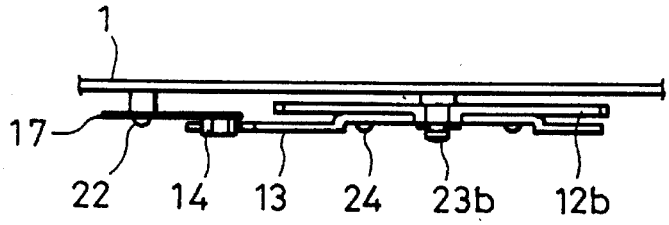
FIG. 3 is a sectional view taken along line A—A of FIG. 2, illustrating a pinion and a size detecting portion.

A disk-shaped cam 13 is fixed to pinion 12*b* by means of a fastener (such as a screw) 24. Cam 13 has projections 13*a*, 13*b* and 13*c* which activate detection switches 14, 15 and 16, respectively. A control circuit of the device detects which detection switches 14, 15 or 16 are on, to determine the size of the sheet. Switches 14, 15 and 16 are mounted on the rear surface of the original platen 1 through a mount plate 17 (see FIGS. 2 and 3).

A click plate spring 18, serving as shift restriction means, has an engaging portion 18*a* at the distal end thereof, which is brought into engagement with the teeth of pinion 12*a*, to lightly fix the sheet guides 2 and 3.

Figure 7:
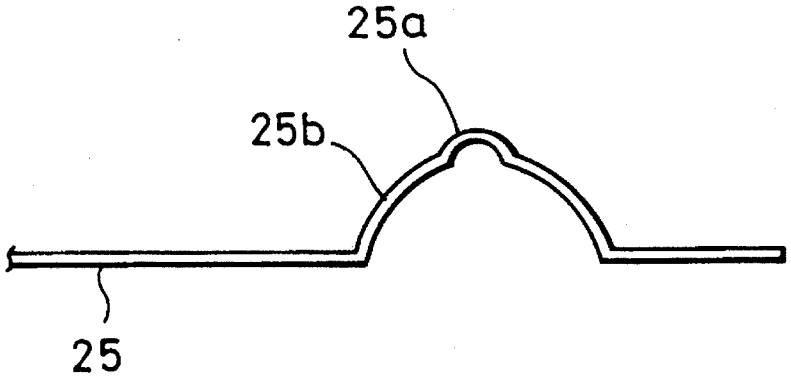
FIG. 7 is an enlarged view of a plate spring 25 shown in FIGS. 5 and 6.

A size display plate 19, serving as a display member, has a groove 19*a* through which two shafts 29 provided at the rear surface of the original platen 1 are passed. A groove 19*b*, formed in the display plate 19, receives the shaft 21. Thus, when sheet guide 3 is moved, shaft 21 is moved, thus moving the display plate in a direction in which the sheets are fed. On the display plate 19 are written sheet sizes 19*c* (see FIG. 1). The sheet size 19*c* corresponding to the position of the sheet guide 3 is displayed in a window 28 formed in the original platen 1. A click plate spring 25 has a small projection 25*a* (see FIG. 7) at an end portion thereof, which is brought into engagement with a thin groove 27 formed along the peripheral edge opinion 12*a* as a first engaging portion so as to allow sheet guides 2 and 3 to be lightly fixed at those positions. Pinion 12*a* has holes 26 formed therein as second engaging portions, into which a large projection 25*b* (see FIG. 7) formed at the end portion of the click plate spring 25 is brought into engagement so as to allow the position of sheet guides 2 and 3 to be fixed. The holes 26 are formed at positions which allow the sheet guides to be fixed at positions where they guide sheets of standardized sizes, like A row and B row. The groove 27 is used when the sheet guides are fixed at positions where they guide nonstandardized sheets.

The device of the present invention may also be arranged such that only one of the click plate springs 18 and 25 is provided.

In the sheet guiding device arranged in the manner described above, when sheet guides 2 and 3 guide small originals, such as an A4 size, they move forward obliquely and hold substantially the center of the edges of the originals. When sheet guides 2 and 3 guide large originals, such as an A3 size, they move backward slantingly in such a manner that the space between the sheet guides 2 and 3 increases, and they hold substantially the center of the edges of those originals. Since sheet guides 2 and 3 are designed to move slantingly with respect to the originals, they can be made fixed against any sidewise shift of the originals, and any outward shift of the sheet guides 2 and 3, which otherwise would occur during the feeding of the originals, can thus be avoided.

In a conventional sheet guiding device, the originals which shift sidewise during feeding shift the sheet guides in an outward direction in such a manner that the space between them increases. This allows the originals to shift at an angle with respect to the sheet feeding direction. This problem may be overcome by fixing the sheet guide by means of a click or a brake provided thereon. However, this makes it difficult to move the sheet guide when the originals are to be held. In other words, the provision of a click or brake, and the ease with which the sheet guides can be moved, are inversely related. Furthermore, since the distance $W_2$ between the shafts 20 and 21 (see FIG. 8) in this embodiment can be made longer than the distance $W_1$ between the shafts 52*c* and 53*c* shown in FIG. 19, backlash of the sheet guides can be reduced in this oblique movement method, and this makes the sheet guides fixed against the sidewise shift of the originals.

Figure 9:
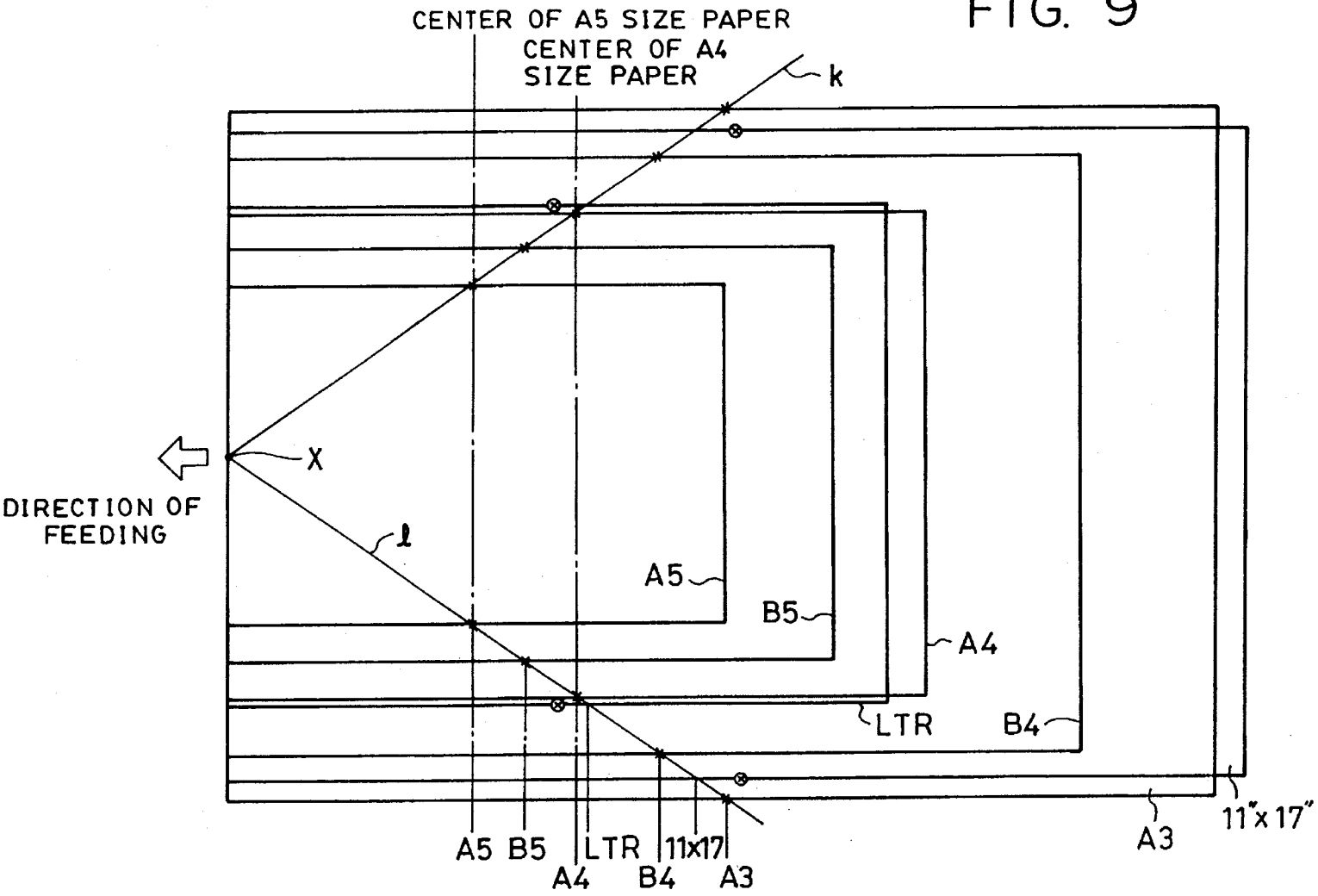
FIG. 9 illustrates various sheet sizes, and straight lines which connect the center of the side edges of those sheet sizes.

Originals having various sizes can be held substantially at the center thereof, because the ratio of the length to width of the sheets of the A and B rows is the same. Regarding this ratio of the length to width, the LTR size employed in North America, and the 11"×17" size are exceptional. However, sheets of these sizes can also be held substantially at the center thereof. FIG. 9 illustrates the position of the sheets having sizes from A5 to A3 which are placed on the original platen 1. In FIG. 9, X indicates the respective central points of the side edges of sheets having various sizes. Points X are located substantially on the straight lines k and 1.

Figure 10:
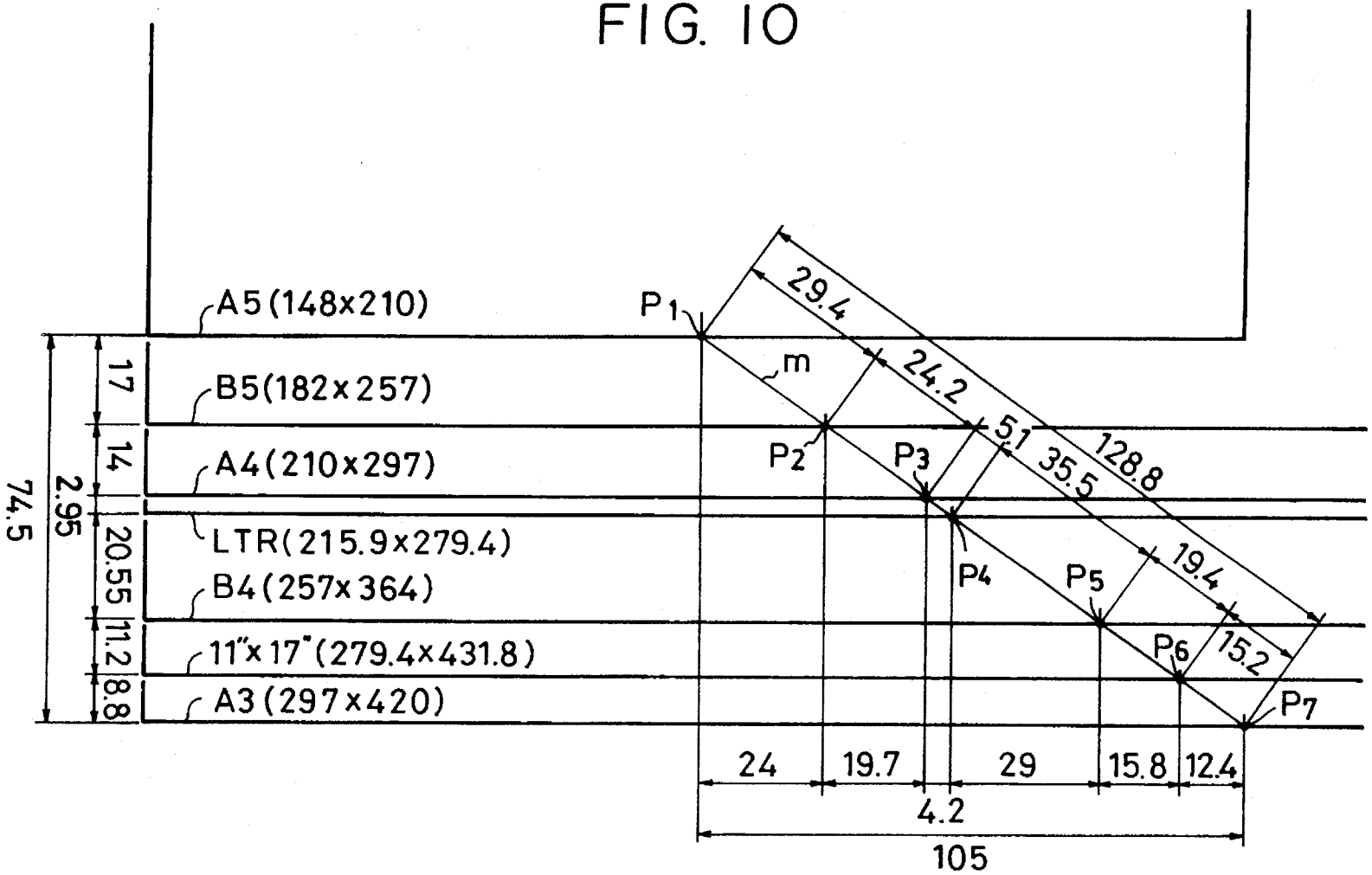
FIG. 10 shows a straight line which connects the longitudinal centers of the sides of sheets having A5 through A3 sizes, the oblique distances, and the longitudinal and lateral distances.
Figure 18:
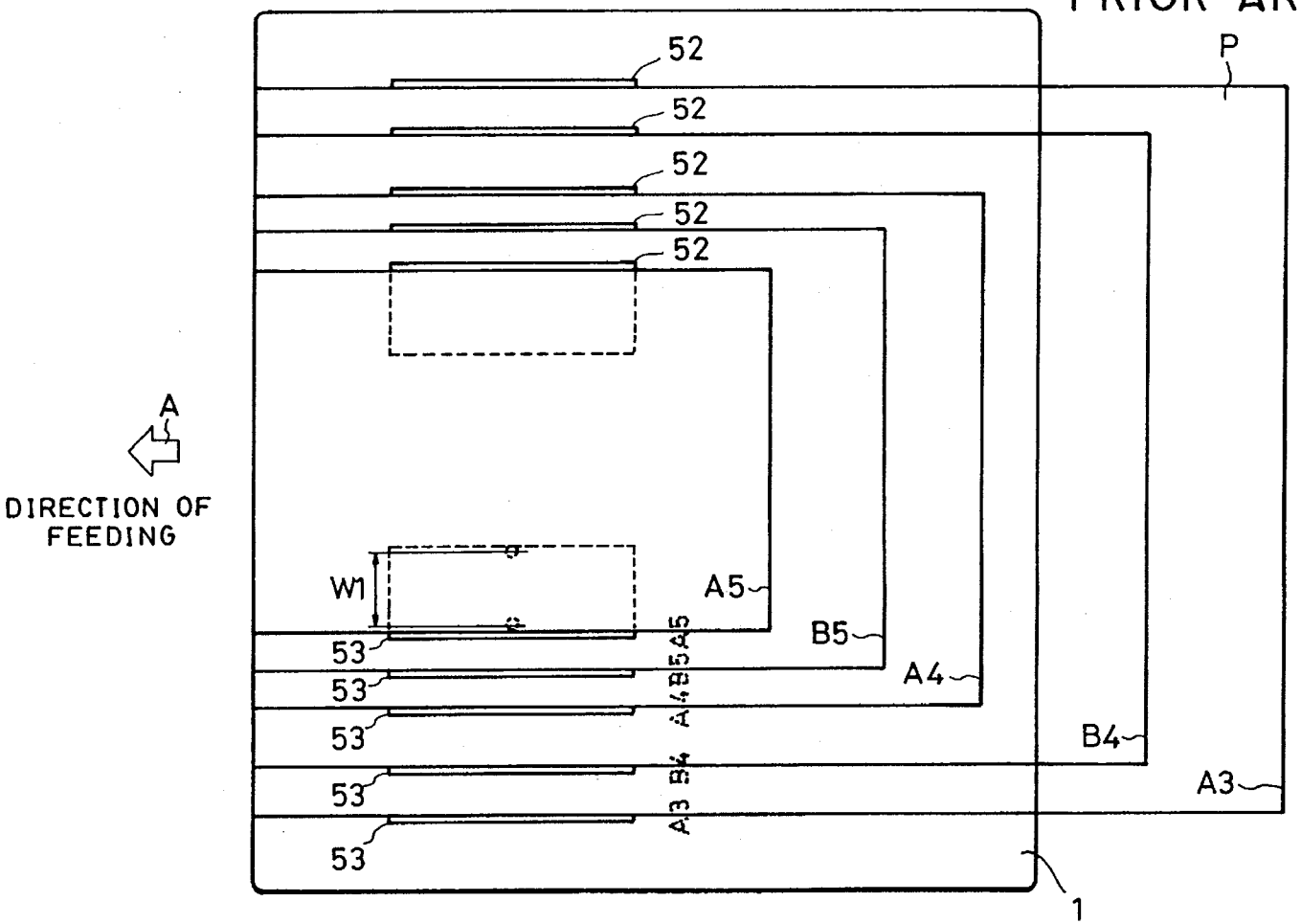
FIG. 18 PRIOR ART
FIG. 18 illustrates the movement of a side guide of a conventional sheet loading base.

In FIG. 1, the window 28 formed in the original platen 1 displays "A3", which is printed on the display board. In the oblique movement method, display of the original's size is facilitated. In a conventional device, the original's size is displayed near the sheet guide by a silk-screening process, as shown in FIG. 18. In this method, originals placed on the original platen 1 hide the displayed size. In the oblique movement method, the original's size can be readily seen regardless of the presence or absence of originals. Furthermore, the display mechanism of the oblique movement method is simple, as can be seen from FIGS. 2 and 4. FIG. 10 illustrates the relation between the oblique movement and longitudinal movement with respect to the side edges of the originals. The unit of measure of the digits indicated in FIG. 10 is millimeters (mm). In FIG. 10, reference characters A5 through A3 denote the positions of the side edges of sheets having A5 through A3 sizes, which are placed on the original platen 1. As shown in FIG. 2, when rack 10 (left) is moved in the direction indicated by an arrow 'e', by moving the shaft of the sheet guide, since the shaft 21 is fitted into the groove in the size display plate 19, the size display plate moves in the sheet feeding direction while being guided by the shaft 29 provided on the original platen 1, whereby the corresponding size is displayed in window 28 (shown in FIG. 1). In FIG. 10, points $P_1$ through $P_7$ indicate the points where the sheet guide 3 is located when it is moved to restrict sheets of various sizes. When the sheet guide 3 is moved, for example, from position A5 to position B5, point P moves from $P_1$ to $P_2$. The distance through which the point P moves at that time is 29.4 mm, and this is equal to the distance through which the shaft 21 is moved at that time. At this time, the size display plate 19 moves by 24 mm.

Figure 11B:
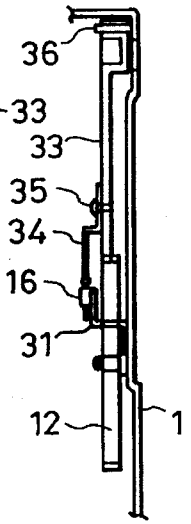
FIG. 11B is a sectional view taken along line C—C of FIG. 11A.
Figure 11A:
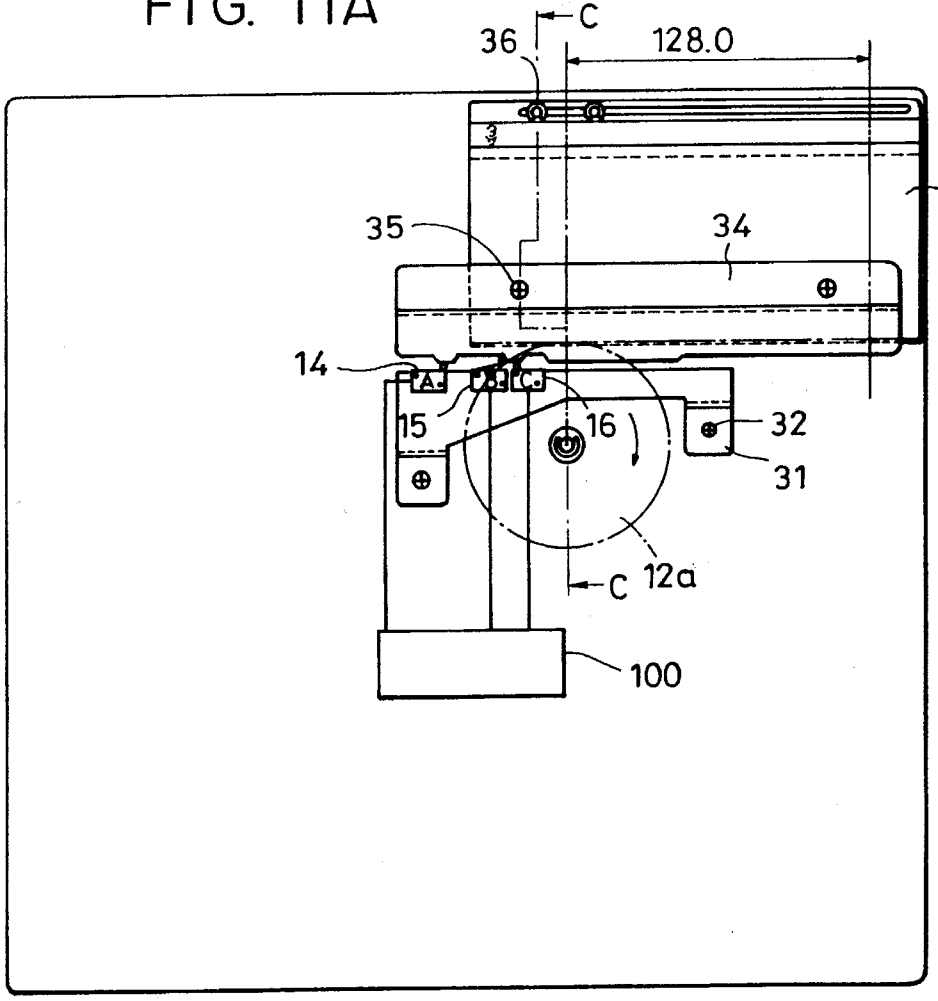
FIG. 11A is a rear view of another embodiment of the present invention.

FIGS. 11A and B illustrate modification of the size display mechanism. In FIGS. 11A and B, illustration of the mechanism for moving the sheet guide 2 is omitted because that mechanism is the same as that shown in FIGS. 1 through 4. Also, in FIGS. 11A and B, illustration of the rack 10, which is in engagement with sheet guide 3 and pinion 12*a*, is omitted because it is the same as that shown in FIGS. 1 through 4.

Figure 12:
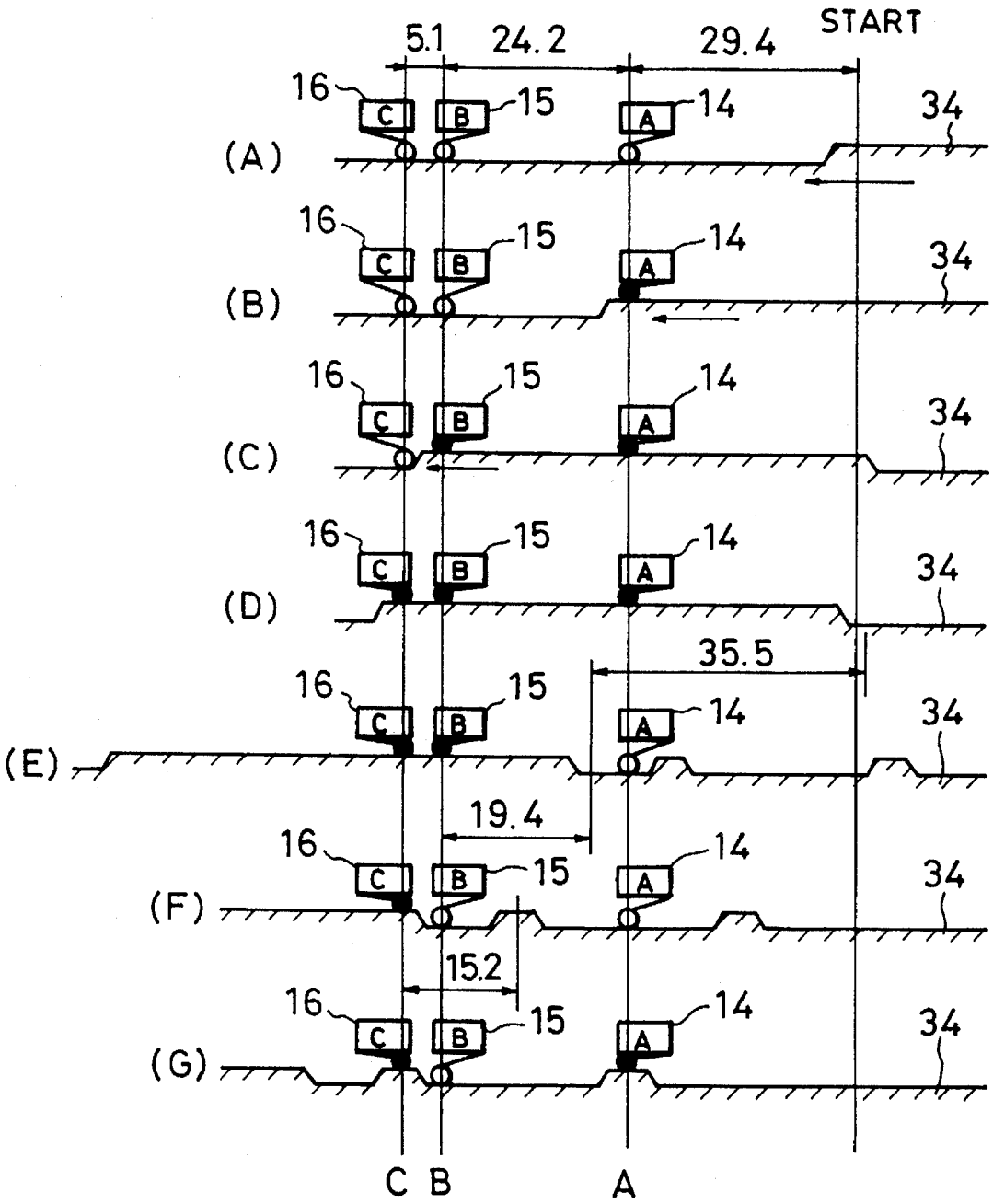
FIG. 12 illustrates the activated states of switches A, B and C, respectively corresponding to various sheet sizes in an enlarged size detection portion of the disk-shaped cam and switches shown in FIG. 2, or in the cam and switches shown in FIG. 11A.

As shown in FIGS. 11A and B, a size display plate 33 has a rack to which the movement of the sheet guide is transmitted from the pinion 12*a*. A cam plate 34 is mounted on the size display plate 33, and a detection switch mounting plate 31 is mounted on the rear surface of the original platen 1 by means of a fastener 32 (such as a screw) as if it overlaps the pinion 12*a*. Detection switches 'A' (14), 'B' (15) and 'C' (16) are mounted on the mounting plate 31 at positions where they face the cam plate 34. FIG. 12 illustrates the positions of the cam plate 34 when the sheet guides 2 and 3 are located to hold sheets having various sizes. The relation between the positions (A) through (G) of The cam plate 34 shown in FIG. 11 and the sheet sizes is shown in Table 1.

TABLE 1

| Position of Cam Plate | Activation of Switch | Position of Sheet Guide |
|---|---|---|
| (A) | All the switches are off | A5 |
| (B) | Only switch A is on (moved from A5 by 29.4 mm) | B5 |
| (C) | Only switches A and B are on (moved from B5 by 24.2 mm) | A4 |
| (D) | Switches A, B and C are on (moved from A4 by 5.1 mm) | LTR |
| (E) | Switches B and C are on (moved from LTR by 35.5 mm) | B4 |
| (F) | Switch C is on (moved from B4 by 19.4 mm) | 11" × 17" |
| (G) | Switches A and C are on (moved from 11" × 17" by 15.2 mm) | A3 |

Table 1 shows the activated state of switch 14 (A), switch 15 (B) and switch 16 (C) when the cam plate 34 is located at positions (A) through (G), and the size of the sheet whose position is restricted by the sheet guides. The switches 14, 15 and 16 are connected to a control circuit 100 which is a determination circuit which determines the position of the sheet guides indicated in Table 1 on the basis of the activated state of switches 14, 15 and 16. The cam 13 shown in FIG. 2 and the switches 14, 15 and 16 will be developed in the same manner as that shown in FIG. 12. A control circuit 100 (see FIG. 11) transmits data on the size of the sheet which is to be guided by the sheet guides 2 and 3, to a device which processes the data.

Figure 13:
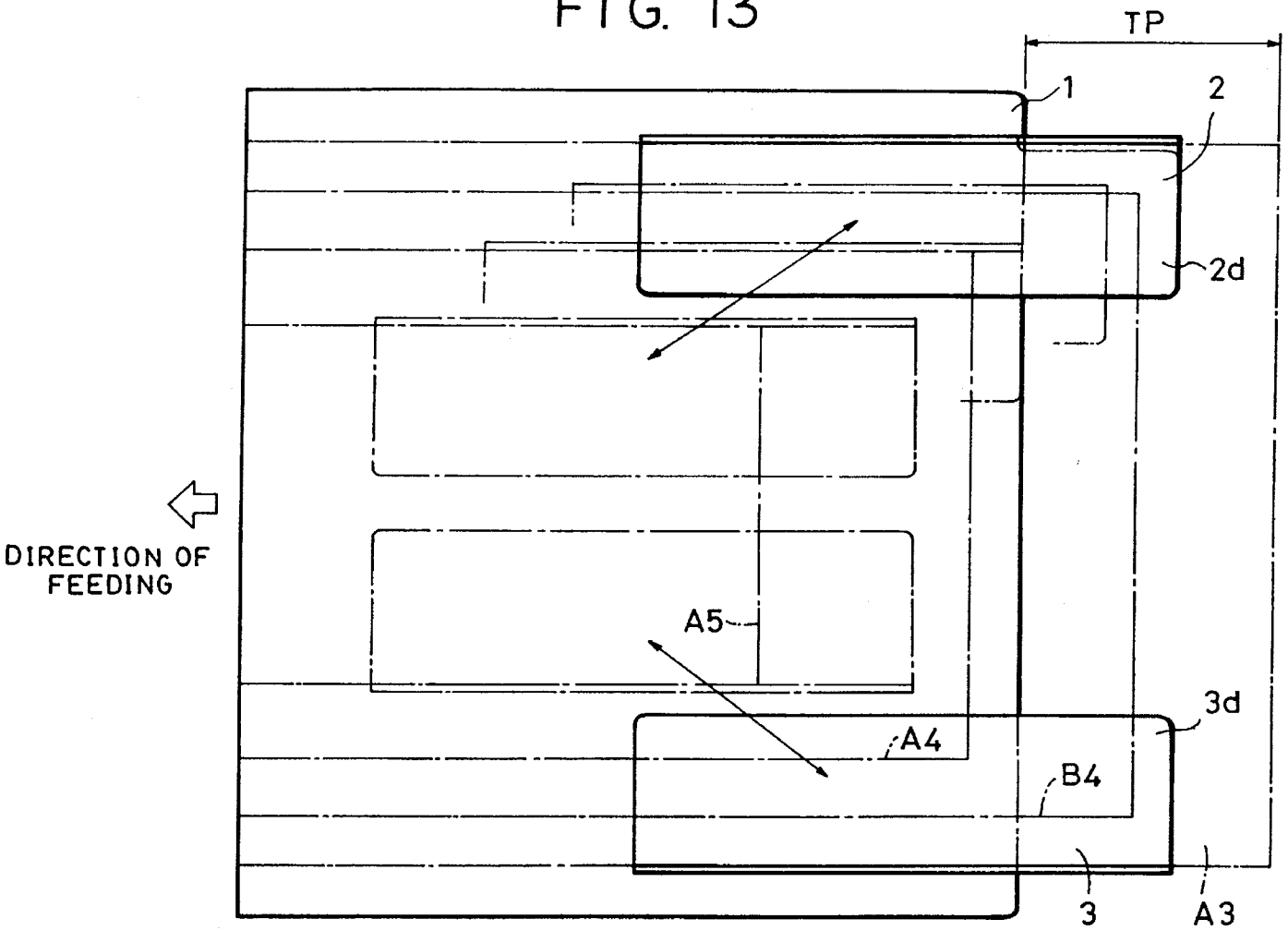
FIG. 13 illustrates a structure for supporting a trailing edge portion of an original document.

In the oblique movement method, the trailing edge portion of sheets having a large size, such as A4 or A4, which extend beyond the rear end of the original platen, can be held by rear portions 2*d* and 3*d* of sheet guides 2 and 3, as shown in FIG. 13. TP indicates the portion of the sheet which extends past the rear end of the original platen 1. As shown wherein, only sheets having A3 and A4 sizes extend beyond the rear end of the platen.

Figure 14:
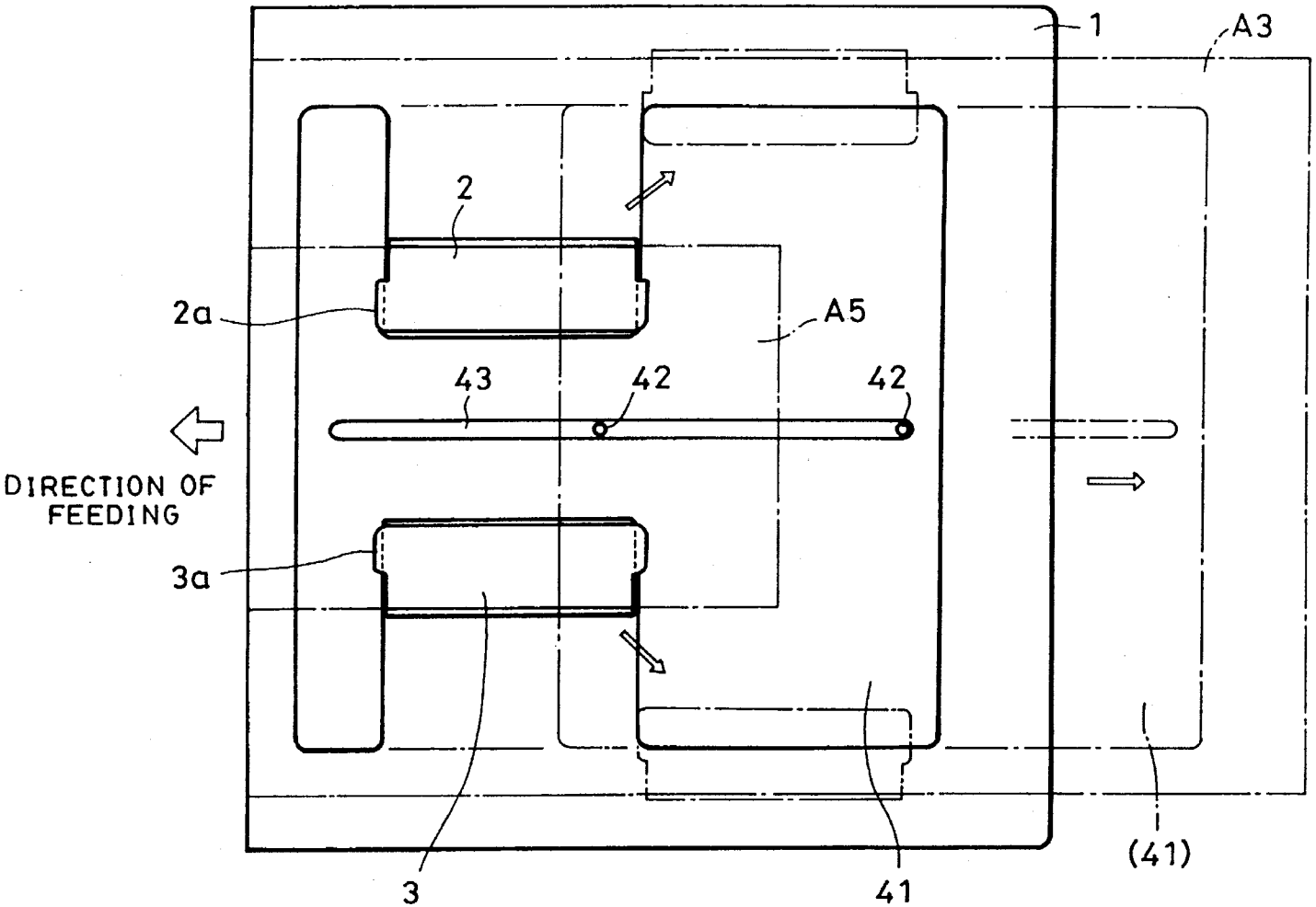
FIG. 14 illustrates a modification of the structure shown in FIG. 13, wherein a movable plate is moved to support the trailing edge portion of an original document.

FIG. 14 illustrates a modification of the mechanism for supporting the trailing edge portion of sheets having a large size. A support plate 41 is pressed by the proximal portions 2*a* and 3*a* of sheet guides 2 and 3. Movement of the support plate 41 in the sheet feeding direction is restricted by sheet guides 2 and 3, while movement thereof in the width direction of the originals is restricted by engagement of pins 42 provided on the original platen with a groove 43 formed in the support plate 41. When sheet guides 2 and 3 are moved such that they can hold large sheets, such as A4 or A3 size, the support plate 41 extends beyond the rear end of the original platen 1 to hold the trailing edge portion of originals having a A4 or A3 size. When sheet guides 2 and 3 are moved to hold small sheets, support plate 41 is also moved such that it lies over the original platen 1. Support plate 41 may be constructed such that it is moved together with the display plate 19 (see FIG. 2). Alternatively, it may be moved by a rack which is in mesh with pinion 12*a* or 13*a*.

Figure 6:
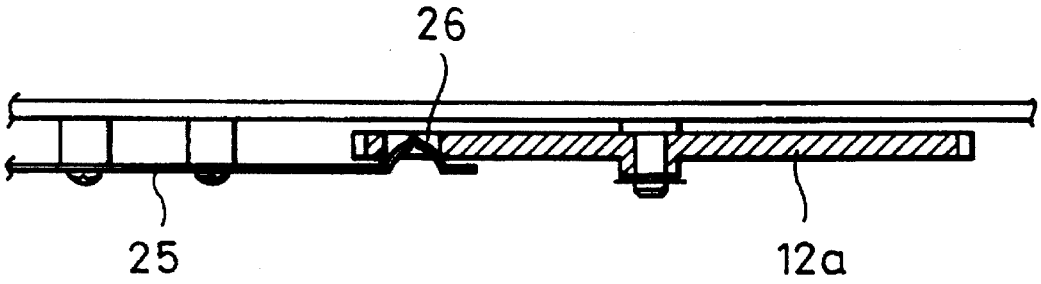
FIG. 6 is a cross-sectional view of a click portion of a large step, shown in FIG. 2.

In FIG. 2, the disk-shaped cam 13 is provided on the pinion 12*b*. The detection switch mounting plate 17 is fixed to the rear surface of the original platen 1 by fasteners 22 (such as screws), and detection switches 'A' (14), 'B' (15) and 'C' (16) are mounted on mounting plate 17 in such a manner that they oppose the disk-shaped cam 13. The positional relation shown in FIG. 12 may be obtained between the detection switches and the cam 13. As pinion 12*b* is moved, switches 14, 15 and 16 are activated in the manner shown in FIG. 6 by cam 13 so as to detect sheet sizes A5 through A3. In the sheet guide oblique movement method, it is possible to detect sheet sizes A4 and LTR, which would be difficult to detect in the conventional method, because the lateral movement is increased by a factor of 1.7, as shown in FIG. 10.

In FIG. 2, the gear of the pinion 12*a* can be used as a click by providing click plate spring 18 on the face of the teeth of pinion 12*a*. If the gear diameter is 0.88 mm, the circumference is 276.5 mm. If the module is 0.5, a single tooth is 1.57 mm, and the pitch of the click is thus 1.57 mm. If the pitch of 1.57 is rough, shoulders may be provided in the gear width direction so as to provide a click of a pitch of 0.5, like a knurling tool. In the case of a click having a pitch of 0.5, the plate spring 18 is moved by about 0.3 mm for each step movement in the direction of the width of the originals because 0.5/1.73=0.29. Thus, a more severe click can be provided. It may be possible to provide deeper shoulders at positions corresponding to the A5, B5, A4, LTR, A4, 11×17 and A3 sizes, so that a stronger clicking can be obtained at these sizes.

A click plate spring 25 may be used in place of click plate spring 18. In that case, instead of using the circumference of the gear, the side surface thereof is used for the click. The side surface of the gear is formed as an irregular surface. Irregularities corresponding to the A5, B5, A4, LTR, B4, 11×7, and A3 sizes may be made deeper so as to provide a clearer clicking at these sizes, as in the aforementioned case. At that time, the click plate spring 25 has two portions which are brought into contact with the shoulders, a large radius portion and a small radius portion provided at the top of the radius portion (see FIG. 7).

Figure 15A:
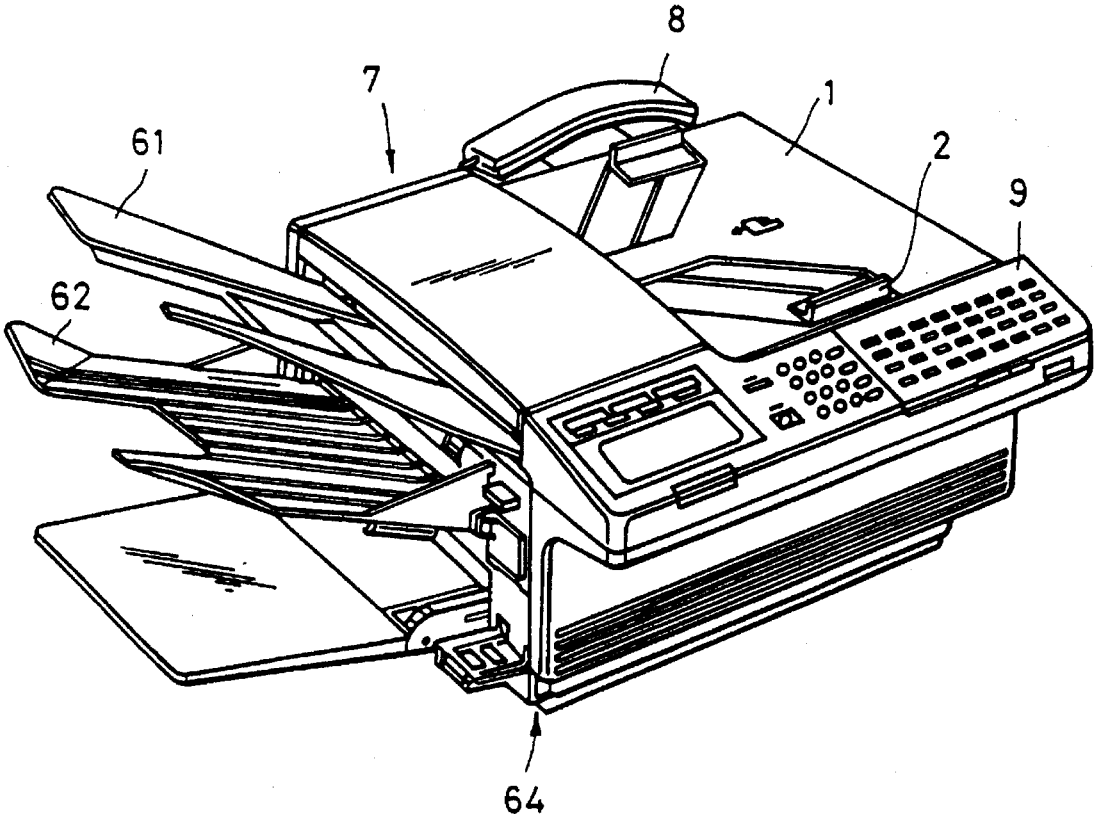
FIG. 15*a* is a perspective view of a facsimile machine to which the present invention is applied.
Figure 15B:
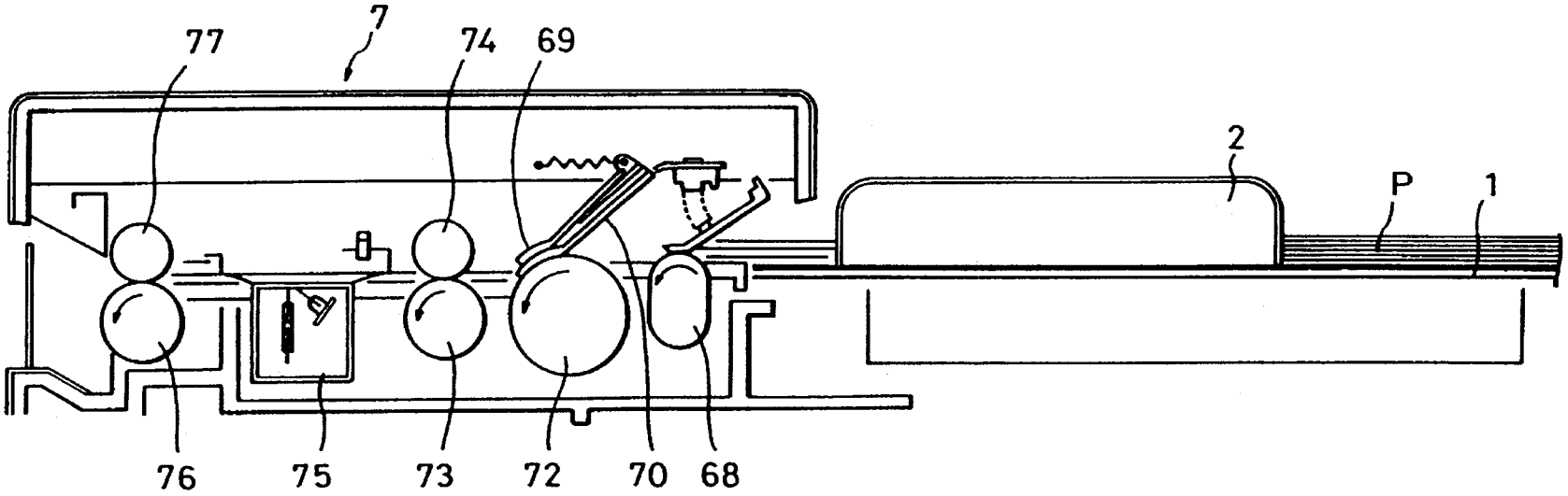
FIG. 15*b* is a cross-sectional view of an original feeding unit and a reading unit of the facsimile machine shown in FIG. 15*a;*

FIG. 15*a* illustrates a facsimile machine having the aforementioned type of sheet guiding device. FIG. 15*b* is a cross-sectional view of an original reading unit and an original feeding unit of the facsimile machine shown in FIG. 15*a*.

In FIG. 15*a*, reference numeral 7 denotes an original reading unit; 8 denotes a telephone set; 9 denotes an operation panel; 61 denotes a discharged original tray onto which the originals whose image has been read by the original reading unit 7 are discharged; 64 denotes a recording paper feeder; and 62 denotes a discharged recording paper tray onto which the recording paper on which images have been recorded is discharged.

In FIG. 15*b*, when a paper feed signal is output, a convey roller 68 is rotated in a direction indicated by an arrow, and the sheets P set on the original platen 1 are thereby moved toward a separation roller 72. The separation roller 72 is also rotated in the direction indicated by an arrow, and sheet located at the lowermost position is thereby fed toward original conveying rollers 73 and 74 utilizing the coefficient of friction at a contact between a separation friction plate 70, mounted on a separation pressing plate 69, and the separation roller 72. Beyond the conveying rollers 73 and 74, the original is read by the reading unit 75, and is then discharged outside of the facsimile machine through discharge rollers 76 and 77.

Figure 16:
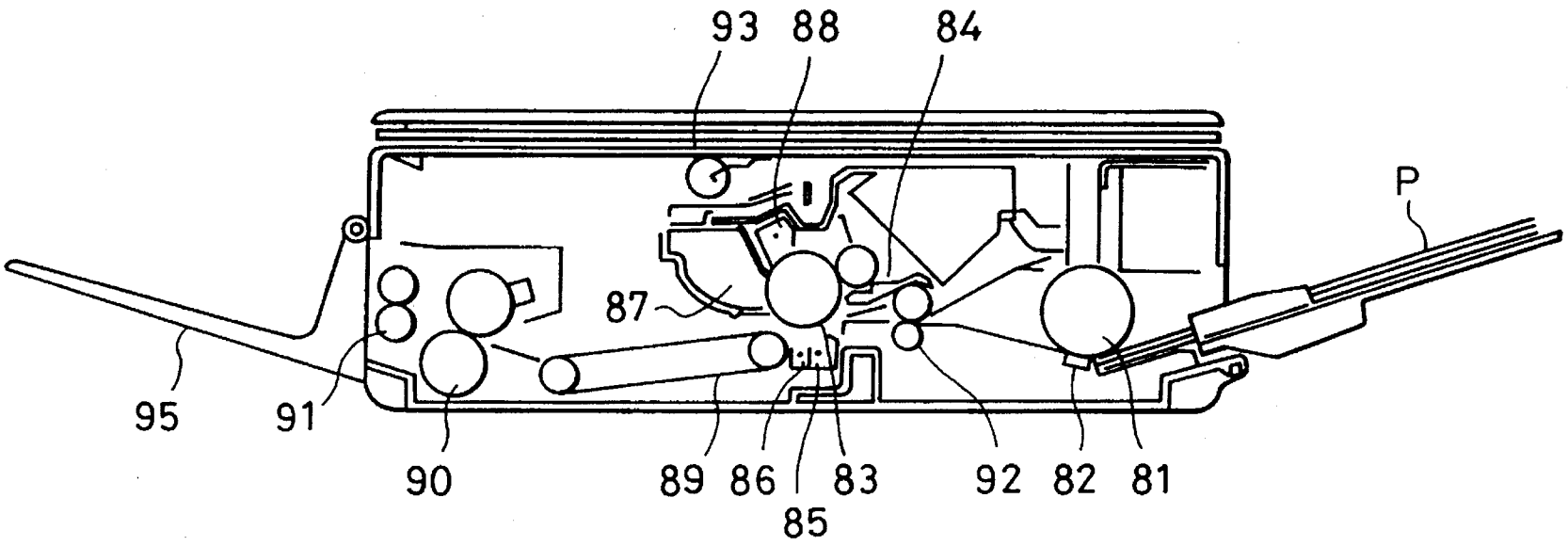
FIG. 16 is a cross-sectional view of a copying machine utilizing a sheet guiding device the present invention.
Figure 17:
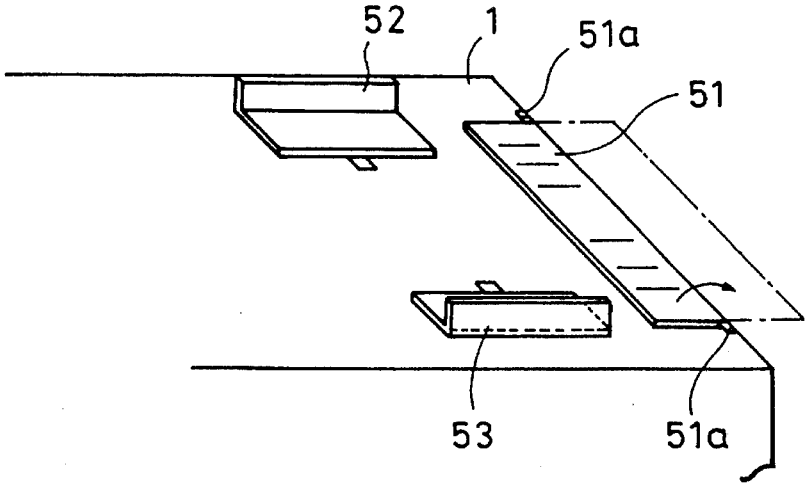
FIG. 17 PRIOR ART
FIG. 17 illustrates a conventional sheet loading base.
Figure 21:
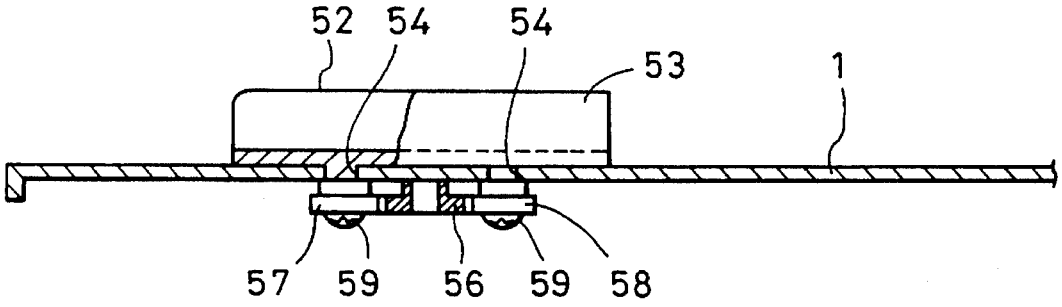
FIG. 21 PRIOR ART
FIG. 21 is a cross-sectional view of the side guides of FIG. 20.

FIG. 16 illustrates a copying machine 80 having the aforementioned type of sheet guiding device.

In FIG. 16, reference character 81 denotes a paper feed roller for feeding sheets P loaded on the sheet guiding device; 82 denotes a separation pad for separating the sheets one by one in cooperation with the paper feed roller 81; and 83 denotes a copying unit which is a cylindrical photosensitive member around which a developer 84 containing toner, a transfer charger 85, a separation charger 86, a cleaner 87 and a primary charger 88 are disposed.

On the downstream side of the copying unit are disposed a conveying device 89, a fixing roller 90, a discharger roller 91 and so on.

In the copying machine 80 arranged in the manner described above, when a paper feed signal is output from a control device (not shown), paper feed roller 81 is rotated so as to feed the sheets P from the sheet guiding device. A sheet P separated by the separation pad 82 is fed to the transfer portion. Feeding of the sheets is timed by register rollers 92.

An original placed on original platen 93 is irradiated with light. The light reflected by the original is illuminated on the photosensitive member through a lens system. The photosensitive member 83 is charged by the primary charger 88 beforehand. When illuminated with light, an electrostatic latent image is formed on the photosensitive member 83. The latent image formed on the photosensitive member 83 is developed by the developer 84 to form a toner image.

After any oblique feeding of the sheet has been corrected by the register rollers 92, the sheet is fed to the copying portion synchronously with rotation of the photosensitive member. In the copying portion, the toner image on the photosensitive member 83 is transferred onto the sheet by the transfer charger 85. The sheet with the image transferred thereon is charged to a polarity opposite to that of the transfer charger 85 by the separation charger 86, and is thereby separated from the photosensitive member 83.

The separated copying paper is conveyed to the fixing roller 90 by the conveying device 89. The fixing roller 90 fixes the non-fixed toner image on the copying paper. The sheet with the fixed image thereon is discharged onto the tray 95 from the copying machine body by discharge rollers 91.

Images are thus formed on sheets fed out from the sheet feeding device by the image forming apparatus.

Figure 8:
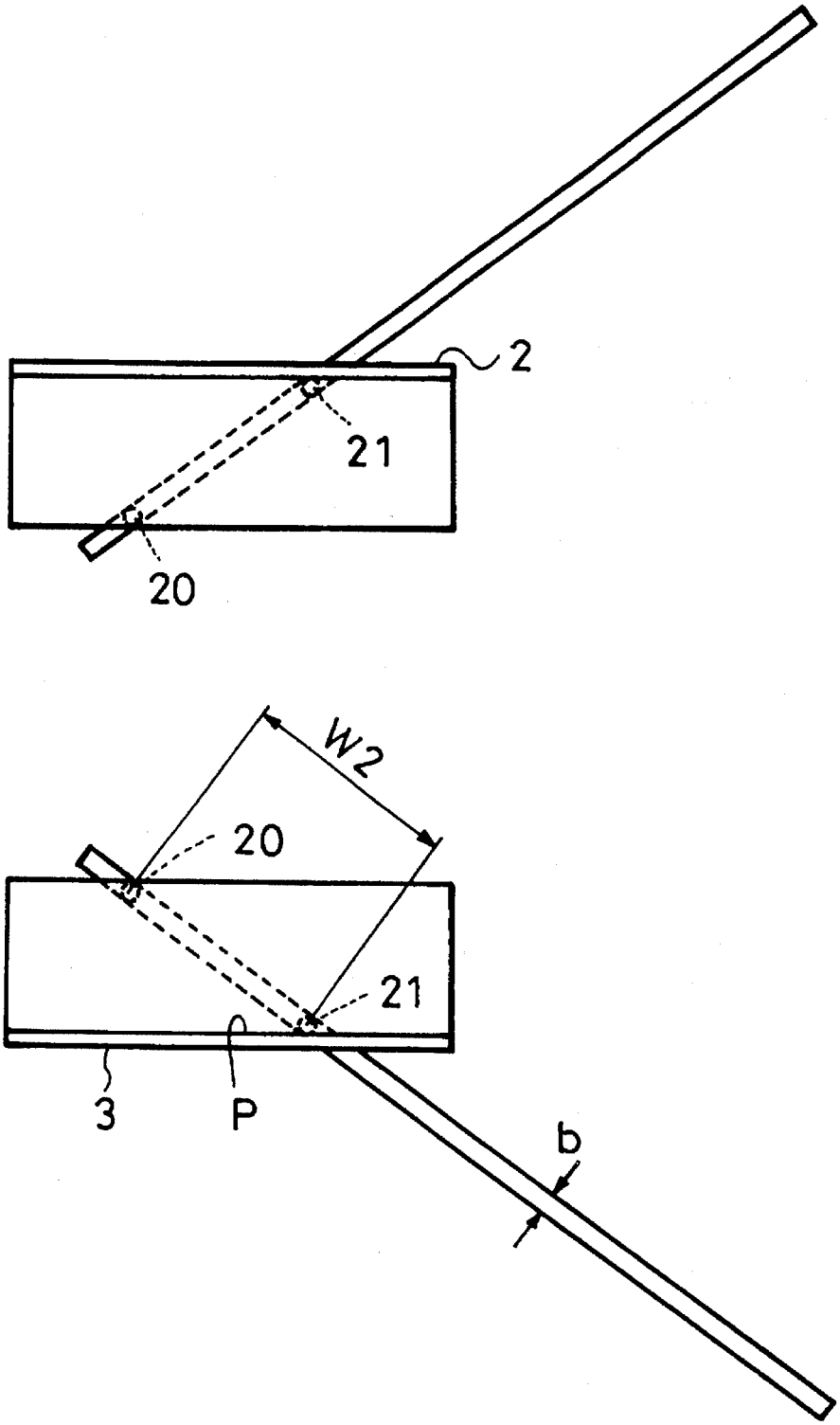
FIG. 8 illustrates an arrangement of the present invention, wherein a width $W_2$ is large with respect to a width $W_1$ of FIG. 19, for reducing backlash.
Figure 19:
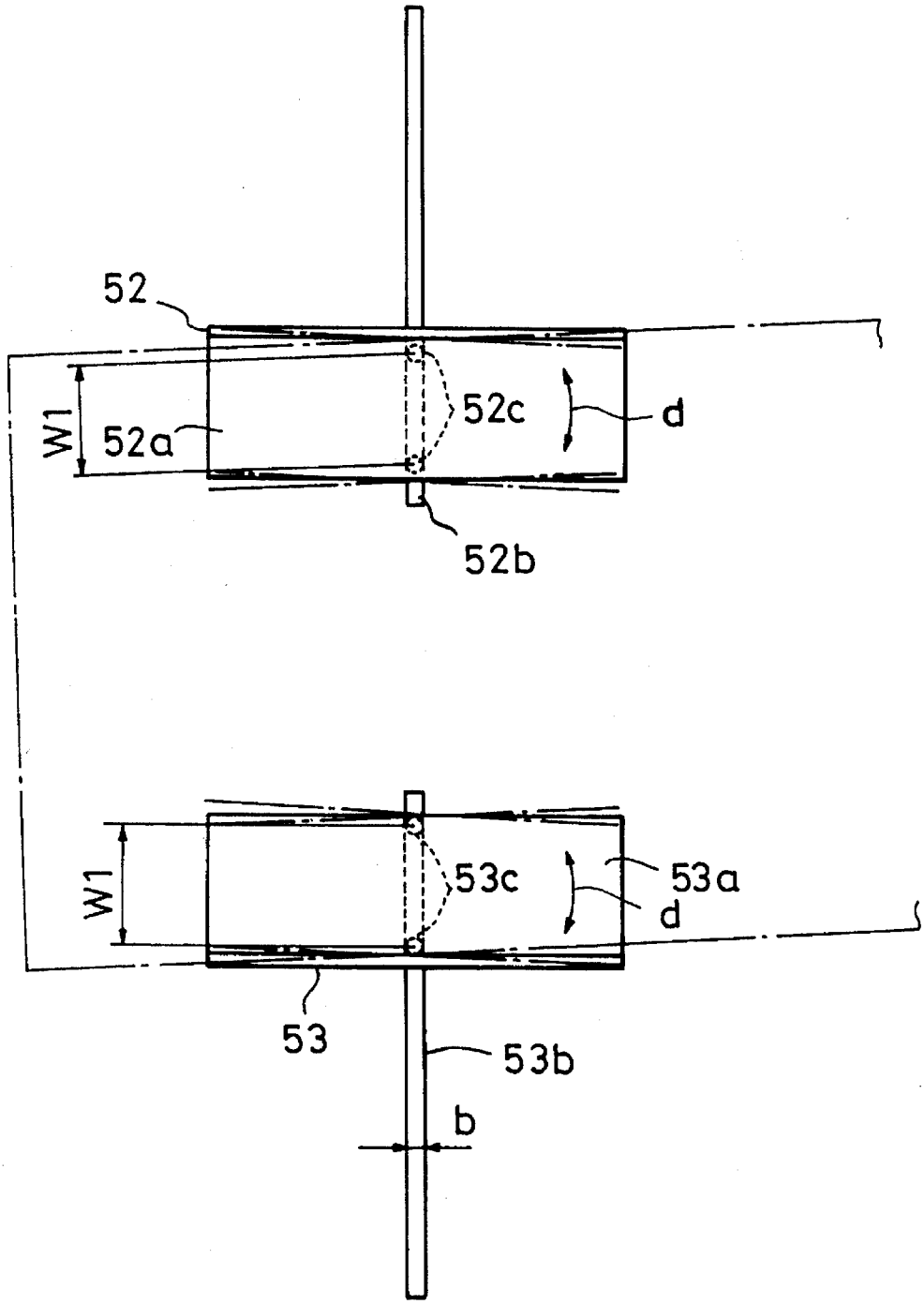
FIG. 19 PRIOR ART
FIG. 19 illustrates the essential parts of a conventional sheet loading device.
Figure 20:
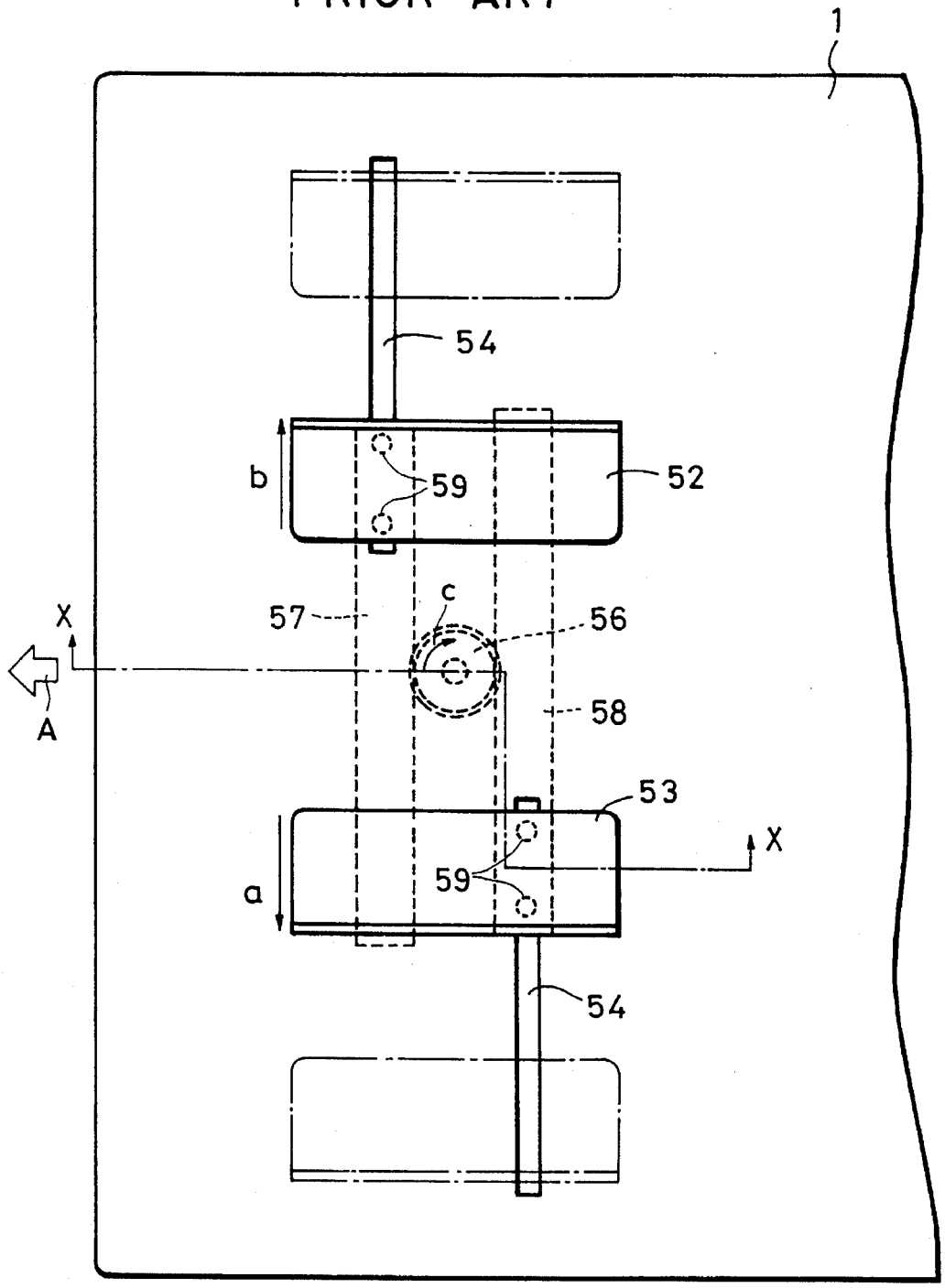
FIG. 20 PRIOR ART
FIG. 20 illustrates conventional rack-and-pinion type side guides.

In the aforementioned embodiment, since the sheet guides 2 and 3 move obliquely, as shown in FIG. 8, $W_2$ can be made about 1.7 times wider than $W_1$ (see FIG. 19). Consequently, backlash of the sheet guides 2 and 3 and deflection thereof in the direction of feeding can be greatly reduced, and stable guiding of the sheets is made possible. The ratio of the lateral movement of the sheet guides 2 and 3 to the oblique movement is 1:1.722. Outward movement of the sheet guides during feeding can be avoided, and oblique feeding of the sheets can thus be avoided. The displayed size can be easily viewed. When originals having a large size are fed, the member for supporting the trailing edge portion of the originals is extended from the rear end of the machine body to receive the originals. The member for supporting the trailing edge portion of the originals is retracted when originals having a small size are fed.

In the aforementioned embodiment, a case in which sheets loaded in a pile are fed out one by one has been described. However, the present invention can also be applied to a case in which a single he sheet is loaded and fed out.

As mentioned above, since the sheet guides are moved obliquely, they can stably guide the sheets substantially at the center thereof in the sheet feeding direction. Furthermore, the sheet guides resist any force exerted thereto in the width direction, and they are not readily moved in an outward direction. This prevents oblique feeding of the sheets. Furthermore, since the sheet guide supporting portion can be made wider, backlash of the sheet guide can be reduced, and oblique feeding of the sheets can thus be avoided.

Since oblique movement of the sheet guides can be readily replaced by longitudinal movement thereof which is more enlarged than the lateral movement of the sheet guides, the display of an original's size is facilitated.

Oblique movement of the sheet guides ensures that the trailing edge portion of the sheets can be reliably held by a simple structure.

Furthermore, detection of the original's size, such as LTR or 11"×17", which would be difficult to detect in a conventional device, is facilitated.

Clicks can be provided on the face of the teeth of the gear. It is also possible to provide clicks corresponding to the A5 through A3 paper sizes and fine clicks on the face of the teeth, or a corresponding face. Also, clicks can be provided on the side surface of the gear.

In the aforementioned embodiments, a sheet guiding device for feeding sheets to a device for reading an original, as well as a sheet guiding device for feeding sheets to a device for forming images on the sheet, have been described. However, the present invention can also be applied to means for aligning sheets when the sheets with images formed thereon by the image forming device are discharged.

In that case, one of the pinions shown in FIG. 2 is rotated by a driving source, such as a motor (not shown), to move the pair of sheet guides toward or away from each other. When a sheet is discharged, the sheet guides are retracted to waiting positions, which are located slightly outside of the width of the sheet. After the sheet has been discharged, the sheet guides are moved from the waiting positions to engage the side edges of the sheet and thereby align the sheet. A bundle of sheets can be readily taken out by performing alignment of the sheets each time a sheet, or a predetermined number of sheets, is discharged. To effect movement of the sheet guides to the sheet aligned positions, the size detection switches employed in the aforementioned embodiment may be used. Alternatively, movement of the sheet guides to the sheet aligned positions may also be controlled by the rotational speed of the motor which is preset according to the size of the sheet.

The present invention has been described with respect to what is presently considered to be the preferred embodiments. It is to be understood that the invention is not limited to the disclosed embodiments and can be applied to any device for restricting the side edges of the sheets.

The invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A sheet guiding device for guiding a sheet to be fed to means for processing the sheet, said device comprising:

sheet loading means on which a sheet is loaded, the sheet having one of a plurality of predetermined sizes;

a pair of restriction members for contacting side edges of a sheet loaded on said sheet loading means, thereby restricting a position of the sheet;

linking means for linking movement of one of said restriction members to movement of the other of said restriction members, said linking means including a pair of pinions which are in mesh with each other, and a pair of racks respectively engaging said pair of restriction members, each of said racks being in mesh with one of said pinions, said linking means linking said restriction members such that a distance between said restriction members varies; and support means for supporting said pair of restriction members such that each said restriction member is movable in a line obliquely relative to a direction in which the sheet is to be fed, wherein said support means moves said restriction members such that each said restriction member is brought into contact with a substantially center portion of a side of the sheet away from ends of the sheet without regard to which of the plurality of predetermined sizes corresponds to the size of the sheet.

2. A sheet guiding device according to claim 1, wherein said support means supports said pair of restriction members such that a distance between said restriction members decreases as said members are moved in the sheet feeding direction.

3. A sheet guiding device according to claim 1, wherein said support means includes a pair of elongated groves formed in said sheet loading means obliquely with respect to the sheet feeding direction, and wherein each said restriction member includes a projecting portion slidably fitted into a respective elongated groove.

4. A sheet guiding device according to claim 1, further comprising size display means for displaying a size of a sheet supported on said sheet loading means, said size display means moving as said restriction members move to display the size of a sheet supported on said sheet loading means.

5. A sheet guiding device according to claim 4, wherein said display means includes a window in which the size is displayed, a display plate on which a plurality of sizes are written, and moving means for moving said display plate such that the size on said display plate displayed in said window corresponds to the position of said restriction members.

6. A sheet guiding device according to claim 1, further comprising positioning means for positioning said restriction members at predetermined positions.

7. A sheet guiding device according to claim 6, wherein said positioning means comprises a click mechanism.

8. A sheet guiding device according to claim 7, wherein said click mechanism positions said restriction members with a strong force at positions where said restriction members restrict predetermined sheet sizes, and positions said restriction members with a weak force at the other positions.

9. A sheet feeding device for feeding a sheet to means for processing the sheet, said device comprising:

sheet loading means on which a sheet is loaded, the sheet having one of a plurality of predetermined sizes;

a pair of restriction members for contacting side edges of a sheet loaded on said sheet loading means, thereby restricting a position of the sheet;

linking means for linking movement of one of said restriction members to movement of the other of said restriction members, said linking means including a pair of pinions which are in mesh with each other, and a pair of racks respectively engaging said pair of restriction members, each of said racks being in mesh with one of said pinions, said linking means linking said restriction members such that a distance between said restriction members varies;

support means for supporting said pair of restriction members such that each said restriction member is movable in a line obliquely relative to a direction in which the sheet is to be fed, wherein said support means moves said restriction members such that each said restriction member is brought into contact with a substantially center portion of a side of the sheet away from ends of the sheet without regard to which of the plurality of predetermined sizes corresponds to the size of the sheet; and feeding means for feeding a sheet restricted by said restriction means to the processing means.

10. A sheet feeding device according to claim 9, wherein said sheet loading means supports a plurality of sheets in a stack, and wherein said feeding means applies a feeding force to a sheet located at the top of the stack of sheets supported by said sheet loading means, thereby to feed out said top sheet.

11. A sheet feeding device according to claim 10, further comprising separation means for separating sheets fed out by said feeding means one by one.

12. A sheet processing device comprising:

sheet loading means on which a sheet is loaded, the sheet having one of a plurality of predetermined sizes;

a pair of restriction members for contacting side edges of a sheet loaded on said sheet loading means, thereby restricting a position of the sheet;

linking means for linking movement of one of said restriction members to movement of the other of said restriction members, said linking means including a pair of pinions which are in mesh with each other, and a pair of racks respectively engaging said pair of restriction members, each of said racks being in mesh with one of said pinions, said linking means linking said restriction members such that a distance between said restriction members varies;

support means for supporting said pair of restriction members such that each said restriction member is movable in a line obliquely relative to a direction in which the sheet is to be fed, wherein said support means moves said restriction members such that each said restriction member is brought into contact with a substantially center portion of a side of the sheet away from ends of the sheet without regard to which of the plurality of predetermined sizes corresponds to the size of the sheet;

feeding means for feeding a sheet restricted by said restriction means; and sheet processing means for processing a sheet fed out by said feeding means.

13. A sheet processing device according to claim 12, wherein said sheet loading means supports a plurality of sheets in a stack, and wherein said feeding means applies a feeding force to a sheet located at the top of the stack of sheets supported by said sheet loading means, thereby to feed out said top sheet.

14. A sheet processing device according to claim 13, further comprising separation means for separating sheets fed out by said feeding means one by one.

15. A sheet processing device according to claim 14, wherein said sheet processing means comprises image forming means for forming an image on a sheet separated and fed by said separation means.

16. A sheet processing device according to claim 14, wherein said sheet processing means comprises image reading means for reading an image formed on a sheet separated and fed by said separation means.

17. A sheet guiding device for guiding a sheet to be fed to means for processing the sheet, said device comprising:

sheet loading means on which a sheet is loaded, the sheet having one of a plurality of predetermined sizes;

restriction means for contacting a side edge of a sheet loaded on said sheet loading means, thereby restricting a position of the sheet, said restriction means contacting a substantially center portion of the side edge of the sheet away from ends of the sheet without regard to which of the plurality of predetermined sizes corresponds to the size of the sheet; and an elongated groove formed in said sheet loading means obliquely relative to a direction in which the sheet is to be fed for slidably receiving a projecting portion provided at said restriction means, wherein said restriction means is obliquely movable in a line along said elongated groove.

18. A sheet feeding device for guiding a sheet to means for processing the sheet, said device comprising:

sheet loading means on which a sheet is loaded, the sheet having one of a plurality of predetermined sizes;

restriction means for contacting a side edge of a sheet loaded on said sheet loading means, thereby restricting a position of the sheet, said restriction means contacting a substantially center portion of the side edge of the sheet away from ends of the sheet without regard to which of the plurality of predetermined sizes corresponds to the size of the sheet;

an elongated groove formed in said sheet loading means obliquely relative to a direction in which the sheet is to be fed for slidably receiving a projecting portion provided at said restriction means, wherein said restriction means is obliquely movable in a line along said elongated groove; and feeding means for feeding a sheet restricted by said restriction means to the processing means.

19. A sheet processing device comprising:

sheet loading means on which a sheet is loaded, the sheet having one of a plurality of predetermined sizes;

restriction means for contacting a side edge of a sheet loaded on said sheet loading means, thereby restricting a position of the sheet, said restriction means contacting a substantially center portion of the side edge of the sheet away from ends of the sheet without regard to which of the plurality of predetermined sizes corresponds to the size of the sheet;

an elongated groove formed in said sheet loading means obliquely relative to a direction in which the sheet is to be fed for slidably receiving a projecting portion provided at said restriction means, wherein said restriction means is obliquely movable in a line along said elongated groove;

feeding means for feeding a sheet restricted by said restriction means; and sheet processing means for processing a sheet fed out by said feeding means.

* * * * *

UNITED STATES PATENT AND TRADEMARK OFFICE

CERTIFICATE OF CORRECTION

PATENT NO. : 5,509,647
DATED : April 23, 1996
INVENTOR(S) : YOSHIHARU IWANAGA

It is certified that error appears in the above-indentified patent and that said Letters Patent is hereby corrected as shown below:

Column 3,
line 46, "side" should read --a side--.
Column 4,
line 51, "device" should read --device of--.
Column 5,
line 47, "opinion" should read --of pinion--.
Column 7,
line 21, "The cam" should read --the cam--;
line 54, "or A4," should read --or B4,--; and
line 59, "wherein," should read --therein,--.
Column 8,
line 4, "A4" should read --B4--;
line 7, "A4" should read --B4--; and
line 48, "11x7," should read --11x17--.
Column 11,
line 39, "groves" should read --grooves--.

Signed and Sealed this

Third Day of September, 1996

*Attest:*

*Attesting Officer*

Bruce Lehman

BRUCE LEHMAN

*Commissioner of Patents and Trademarks*